United States Patent [19]

Yan

[11] Patent Number: 4,705,534

[45] Date of Patent: Nov. 10, 1987

[54] CETANE NUMBER OF DIESEL FUEL BY INCORPORATING POLYNITRATE ESTERS AND STABILIZERS

[75] Inventor: Tsoung Y. Yan, Philadelphia, Pa.

[73] Assignee: Mobil Oil Corporation, New York, N.Y.

[21] Appl. No.: 798,517

[22] Filed: Nov. 15, 1985

[51] Int. Cl.[4] ..... C10L 1/18; C10L 1/22

[52] U.S. Cl. ..... 44/57; 44/72

[58] Field of Search ..... 44/53, 57, 72

[56] References Cited

U.S. PATENT DOCUMENTS

| | | | |
|---|---|---|---|
| 2,314,137 | 3/1943 | Fuller et al. | 44/57 |
| 2,402,427 | 6/1946 | Miller et al. | 44/57 |
| 2,645,079 | 7/1953 | Doumani et al. | 44/57 |
| 3,000,971 | 9/1961 | Frankel et al. | 44/57 |
| 4,049,457 | 9/1977 | Rice et al. | 96/88 |
| 4,312,934 | 1/1982 | Rice et al. | 430/294 |
| 4,334,008 | 6/1982 | Rice et al. | 430/270 |
| 4,405,335 | 9/1983 | Seemuth | 44/53 |
| 4,406,665 | 9/1983 | Filbey | 44/53 |
| 4,417,903 | 11/1983 | Hinkamp | 44/53 |
| 4,494,961 | 1/1985 | Venkat et al. | 44/57 |
| 4,522,630 | 6/1985 | Seemuth | 44/53 |
| 4,585,461 | 4/1986 | Gorman | 44/53 |
| 4,588,417 | 5/1986 | Zaweski et al. | 44/57 |

FOREIGN PATENT DOCUMENTS

| | | |
|---|---|---|
| 3233834A1 | 3/1984 | Fed. Rep. of Germany . |

*Primary Examiner*—Jacqueline V. Howard

*Attorney, Agent, or Firm*—Alexander J. McKillop; Michael G. Gilman; Van D. Harrison, Jr.

[57] ABSTRACT

Mixtures of polynitrate esters and selected amines are effective in improving the cetane number of diesel and alcohol fuels.

17 Claims, No Drawings

CETANE NUMBER OF DIESEL FUEL BY INCORPORATING POLYNITRATE ESTERS AND STABILIZERS

FIELD OF THE INVENTION

This invention is concerned with improved diesel fuel. More particularly it is concerned with improving the cetane number thereof by adding polynitrate esters and stabilizers for the esters.

DESCRIPTION OF THE PRIOR ART

Cetane number improvers have been used in the form of additives to upgrade marginal diesel fuels to meet specifications for ignition quality. Examples of these materials are the commercially marketed octyl nitrates, cyclohexylnitrate, disclosed in German Offenlugenschrift No. DE3233834A1, primary alkyl nitrate esters such as 2-methyl-2-nitropropyl nitrate (U.S. Pat. No. 4,417,903) and 3-tetrahydrofuranyl nitrate (U.S. Pat. No. 4,406,665). More recently U.S. Pat. No. 4,522,630 has disclosed the use of tetrahydro-2,5-furandimethanoldinitrate as a cetane improver for diesel fuels. Although many of these polynitrate esters will function well as cetane improvers, their use is hazardous in that they are explosives and are difficult to handle safely.

A primary object of this invention therefore is to provide an additive for diesel fuels which will not only be effective as a cetane improving additive, but will also be safe to handle.

SUMMARY OF THE INVENTION

In brief, this invention comprises the addition of polynitrate esters in admixture with certain stabilizing amine compounds to diesel fuel, thereby increasing the cetane rating of diesel fuel, and lessening the hazard of working with these polynitrate esters.

DESCRIPTION OF PREFERRED EMBODIMENTS

In its most preferred embodiment this invention is a liquid additive for diesel fuels to improve their cetane number comprising a mixture of the aforementioned polynitrate esters and stabilizers.

The preferred polynitrate esters are selected from the group consisting of ethylene glycol dinitrate (EGD), diethylene glycol dinitrate, DEGN, triethylene glycol dinitrate (TEGN), 2-methyl-2 [(nitroxy)methyl]-1,3-propanediol dinitrate (PDN). These polynitrates can also be used in mixtures. Other polynitrate esters useful are nitroglycerin, cellulose tri, di, and mononitrate and their mixtures.

These polynitrates are found to be effective but are generally considered to be explosive and dangerous to handle. The safety of handling these polynitrates is assured by use of a proper amount of stabilizer. The stabilizers are amine compounds selected from the group consisting of diphenyl amine, diethyl diphenylurea and 2-dinitrodiphenylamine.

The polynitrate esters are mixed with the stabilizers at a concentration level of 0.01 to 5% of stabilizer by weight, preferably 0.1 to 1% based on the polynitrate esters. Too much stabilizer will render the cetane improver ineffective and too little stabilizer will make it unsafe to use. For example, a mixture of 99% DEGN and 1% diphenylamine is an excellent cetane improver.

To improve the safety of handling the polynitrate esters they are diluted in a liquid diluent in admixture with a stabilizer to form stock solutions. Preferably the diluent is a diesel fuel. The stock solutions are made up to contain 10 to 50 percent by weight of the mixture of polynitrate ester and stabilizer.

The mixture of polynitrate ester and stabilizer, preferably in the stock solution form, is mixed in the diesel oil to be treated for cetane improvement and used for fuel in sufficient quantity to result in a concentration of between about 0.05 and about 1% by weight of the polynitrate ester in the diesel oil.

The polynitrates are more effective than the commercial mono-nitrates, such as octyl nitrates commercially used, because of their higher potential for generating reactive species, RO and $NO_2$ to ignite oxidation. The polynitrates are generally more effective than mononitrates by a factor of 2 to 5, i.e., the dosage requirement for polynitrates for similar cetane number improvement is ½ to 1/5 that required for mononitrates.

These cetane improvers are especially useful for low quality diesel fuel such as coal derived diesel fuel or ethanol. The cetane number of ethanol is about 8. For example, to increase the cetane number of ethanol to 52, 16% by weight of a commercial cetane improver (DII-3) is required but only 5% of (diethylene glycol trinitrate) (DEGN) is required to achieve the same effect. This result shows that DEGN is more effective than octyl nitrate (DII-3) by a factor of 3.2. For similar improvement, the dosage required for triethylene glycol nitrate (TEGN) is 4%, indicating that TEGN is more effective than DII-3 by a factor of 4.

What is claimed is:

1. A liquid fuel composition adapted for use in a diesel engine, comprising diesel fuel boiling within the range of 200°–850° F. containing a cetane number-increasing amount of a mixture of fuel-soluble polynitrate esters and a stabilizer selected from the group consisting of diphenyl amine, diethyl diphenylurea and 2-dinitrodiphenylamine.

2. The composition of claim 1 wherein the polynitrate ester is selected from the group consisting of ethylene glycol dinitrate, diethylene glycol dinitrate, triethylene glycol dinitrate, 2-methyl-2 [(nitroxy)methyl]-1,3-propanediol dinitrate ester, butanetriol trinitrate 1,3, propanediol dinitrate, nitroglycerin, cellulose tri, di, and mononitrate and mixtures thereof.

3. The composition of claim 1 wherein the concentration of stabilizer is between about 0.01 percent and about 5 percent of the weight of polynitrate ester present.

4. The composition of claim 1 wherein the concentration of stabilizer is between about 0.1 percent and about 1 percent of the weight of polynitrate ester present.

5. The composition of claim 1 wherein the concentration of polynitrate ester in said liquid fuel composition is between about 0.05 percent and about 1 percent of the weight of liquid fuel.

6. The composition of claim 1 wherein the polynitrate esters are mixtures of mono, di- and polynitrates.

7. The composition of claim 1 wherein the polynitrate esters are mixtures of two or more polynitrate esters selected from the group consisting of ethylene glycol dinitrate, diethylene glycol dinitrate, triethylene glycol dinitrate, 2-methyl-2[(nitroxy)methyl]-1,3-propanediol dinitrate, and nitroglycerin.

8. The composition of claim 1 wherein said fuel is a coal derived diesel fuel.

9. A method for improving the cetane-rating of a liquid diesel fuel comprising adding to said fuel: (1) a cetane-number-increasing amount of a fuel-soluble polynitrate ester and (2) a stabilizer selected from the group consisting of diphenyl amine, diethyl diphenylurea and 2-dinitrodiphenylamine and mixtures thereof.

10. The method of claim 9 wherein the polynitrate ester is selected from the group consisting of ethylene glycol dinitrate (EGD), diethylene glycol dinitrate, DEGN, triethylene glycol dinitrate (TEGN), 2-methyl-2 [(nitroxy)methyl]-1,3-propanediol dinitrate (PDN), nitroglycerin, cellulose tri, di, and mononitrate and their mixtures.

11. The method of claim 9 wherein the concentration of stabilizer is between about 0.01 percent and about 5 percent of the weight of polynitrate ester present.

12. The method of claim 9 wherein the concentration of stabilizer is between about 0.1 percent and about 1 percent of the weight of polynitrate ester present.

13. The method of claim 9 wherein the concentration of polynitrate ester in said liquid fuel composition is between 0.05 percent and 1 percent of the weight of liquid fuel.

14. The method of claim 9 wherein said fuel is a coal derived diesel fuel.

15. A method for physically handling and transporting a diesel fuel containing an unstable polynitrate ester comprising adding to said mixture a stabilizer selected from the group consisting of diphenyl amine, diethyl diphenylurea, and 2-dinitrodiphenylamine.

16. The method of claim 15 wherein said polynitrate ester is selected from the group consisting of ethylene glycol dinitrate, diethylene glycol dinitrate, triethylene glycol dinitrate, 2-methyl-2 [(nitroxy)methyl]-1,3-propanediol dinitrate ester, butanetriol trinitrate 1,3, propanediol dinitrate, nitroglycerin, cellulose tri, di, and mononitrate and mixtures thereof.

17. The method of claim 15 wherein the amount of stabilizer present is between about 0.01 and about 5 percent of the weight of polynitrate ester present.

* * * * *